US009281638B2

(12) United States Patent
McBroom et al.

(10) Patent No.: US 9,281,638 B2
(45) Date of Patent: Mar. 8, 2016

(54) CONNECTORS

(71) Applicant: Apple Inc., Cupertino, CA (US)

(72) Inventors: Michael D. McBroom, Leonard, TX (US); Brian T. Sudderth, Leonard, TX (US); Daniel L. McBroom, Leonard, TX (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 14/041,842

(22) Filed: Sep. 30, 2013

(65) Prior Publication Data

US 2015/0093919 A1 Apr. 2, 2015

(51) Int. Cl.

| | |
|---|---|
| ***H01R 9/05*** | (2006.01) |
| ***H01R 24/38*** | (2011.01) |
| *H01R 13/62* | (2006.01) |
| *H01R 103/00* | (2006.01) |
| *H01R 31/06* | (2006.01) |

(52) U.S. Cl.

CPC ..... *H01R 24/38* (2013.01); *H01R 13/6205* (2013.01); *H01R 31/06* (2013.01); *H01R 2103/00* (2013.01)

(58) Field of Classification Search

CPC ..... H01R 9/05; H01R 13/6205

USPC ..... 439/38–39, 680, 40, 289, 180, 21, 246, 439/379

See application file for complete search history.

(56) References Cited

U.S. PATENT DOCUMENTS

| | | | | |
|---|---|---|---|---|
| 3,521,216 | A * | 7/1970 | Tolegian | 439/39 |
| 3,808,577 | A * | 4/1974 | Mathauser | 439/39 |
| 5,941,729 | A * | 8/1999 | Sri-Jayantha | 439/505 |
| 2013/0303000 | A1 * | 11/2013 | Witter et al. | 439/39 |
| 2014/0235075 | A1 * | 8/2014 | Kim et al. | 439/39 |

* cited by examiner

*Primary Examiner* — Edwin A. Leon

(74) *Attorney, Agent, or Firm* — Kilpatrick Townsend & Stockton LLP

(57) ABSTRACT

Pairs of matching connectors are described. The matching connectors can provide power to a powered device and/or communicate signals to a device. The matching connectors can include electrical contacts. In one example, the electrical contacts may be ring-shaped and several electrical contacts may be concentrically positioned. In one example, the matching connectors can be held together by a locking future that can be a magnet located in one or both of the matching connectors. In one example, the matching connectors can be connected by the angular of one of the connectors relative to the other. This rotation of one of the connectors relative to the other can engage the contacts of the connectors.

18 Claims, 8 Drawing Sheets

CONNECTORS

BACKGROUND OF THE INVENTION

Mobile devices such as laptop and notebook computers, media players, smart phones, tablets, and others have become ubiquitous in the last few years and the popularity shows no sign of abating. Further, ever more devices are being used by consumers that require electric power. To meet demand, designers have developed a wide range of devices having a constellation of form factors and features.

While features and form factors of devices have changed and evolved over time, electric devices rely on power to perform their functions. This power is frequently provided to the device via a combination of one or several plugs, connectors, and cords. While devices have evolved to be more compact, sleek, and reliable, many of the power providing components have not experienced similar development. Thus, apparatuses, systems, and methods are needed that improve the function of power providing features.

DETAILED DESCRIPTION OF THE INVENTION

Figure 1:
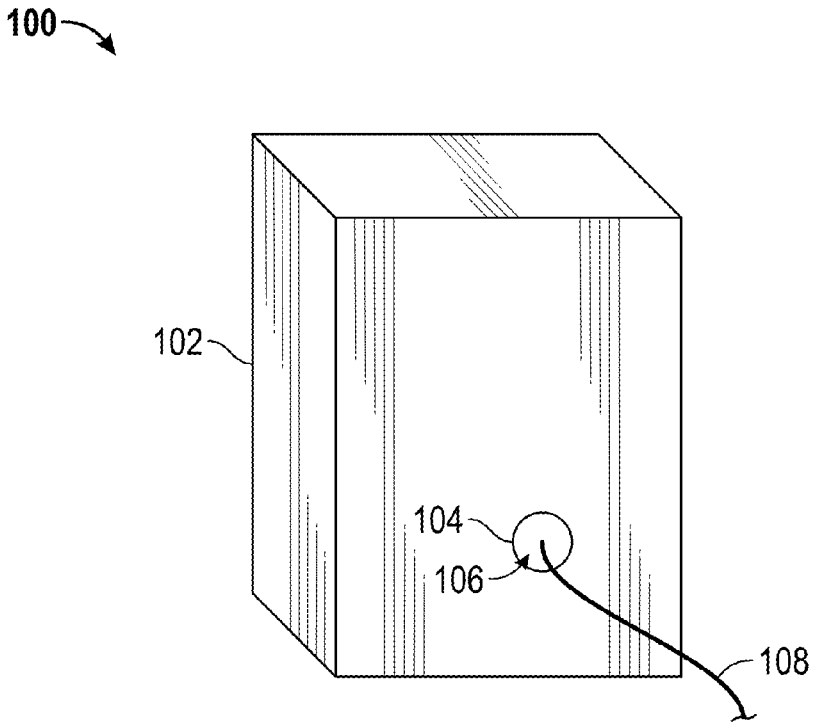
FIG. 1 is a perspective view of one embodiment of powered system.

Some embodiments relate to a connector and/or a pair of matching connectors. This connector and/or the pair of matching connectors can connect a powered device to a power source. The connector and/or the pair of matching connectors can include features that decrease space use by the connector and/or portion of the pair of matching connectors located within the powered device. Advantageously, these features can facilitate in the design and creation of slimmer and more compact powered devices. The connector and/or pair of matching connectors can further include features that can increase the safety of the connector and/or pair of matching connectors such as by, for example, decreasing the force to separate the native connector and/or mated pair of matching connectors. This decreased pullout force can further decrease the likelihood of damage to the powered device in the event that mated connector is and/or mated pair of matching connectors are rapidly separate.

Some embodiments relate to a device connector located on the powered device and a matching power connector. In one embodiment, the device connector can include several electrical contacts that can be, for example ring shaped. These electrical contacts can be positioned such that they are concentric. In one embodiment, the device connector can further include a locking feature such as, for example, a magnet, that can facilitate in connecting the device connector with the power connector.

In one embodiment, the power connector can include several electrical contacts that can be, for example, ring-shaped. The electrical controls of the power connector can be sized, shaped, and positioned to mate with the electrical contacts of the device connector. In one embodiment, these electrical contacts of the power connector can be concentrically arranged.

The power connector can further include features that can facilitate in the alignment and connecting of the device connector and the power connector. In one embodiment, for example, the power connector can include an insert that fits into a receptacle of the device connector. Insertion of the power connector into device connector can be facilitated by tapering the sides of the insert of the power connector. This taper can facilitate in the self-alignment of the insert of the power connector within the receptacle of the device connector. In some embodiments, the power connector can further include a locking feature such as, for example, a magnet, that can facilitate in connecting with the device connector, and in maintaining the connection with device connector.

In one embodiment, the power connector can include several twist lock receptacles and several contacts, and in one embodiment, the device connector can include several twist lock contacts. The twist lock receptacles can be sized and shaped to receive a twist lock contact when the power connector is in a first position, and to retain the twist lock contact when power connector is in a second position.

The power connector and the device connector can further include one or several clocking features, and one or several locking features. In some embodiments, the clocking features can facilitate the proper placement of the power connector with respect to the device connector. In some embodiments, the locking features can secure the connection between the power connector and the device connector.

With reference now to FIG. 1, a perspective view of one embodiment of a powered system 100 is shown. The powered system 100 can include a powered device 102 that can be any device, component, and/or system that consumes electrical power including, for example, AC power or DC power. In some embodiments, the power system 100 can include a computer, an appliance including, for example, a washing machine, a dishwasher, a dryer, a refrigerator, an oven, or a stove, a handheld device, or the like. The powered system 100 can be a variety of shapes and sizes and can be made from a variety materials.

The powered device 102 can include a device connector 104. The device connector 104 can be a component of the powered device 102 that can be used, for example, in providing power to the powered device 102 or in creating a communicating connection with the powered device 102. In some embodiments, the device connector 104 can be a component of the powered device 102 in that the device connector 104 is not disconnectable from the powered device 102 in the normal operation of the powered device 102 or of the device connector 104. In some embodiments, the device connector 104 can include an insert or a receptacle, and in some embodiments, the device connector 104 can be a male connector or a female connector. In one embodiment, the device connector 104 can be a male receptacle connector.

The device connector 104 can be any desired shape or size and can be made from a variety of materials. In some embodiments, the device connector 104 can be shaped to define a cylindrical volume within a receptacle and can be made from a nonconductive material, or a material having a nonconductive coating.

The powered system 100 can further include a power connector 106. The power connector 106 can connect with the device connector 104 to provide power to the powered device 102 and/or to establish a communicating connection with the powered device 102, and the power connector 106 can disconnect from the device connector 104. In some embodiments, the power connector 106 can include an insert or a receptacle, and in some embodiments, power connector 106 can be a male connector or a female connector. In one embodiment, the power connector 106 can be a female insert connector.

The power connector 106 can be any desired size or shape, and can be made from a variety of materials. In some embodiments, the power connector 106 can include a cylindrically shaped insert and can be made from a nonconductive material, or from a material having a nonconductive coating.

The powered system 100 can further include a cable 108. The cable 108 can be connected to the power connector 106 and can allow the transmission of power and/or communicating signals to the power connector 106. The cable 108 can be any desired shape or size, and can be made from a variety materials.

Figure 2:
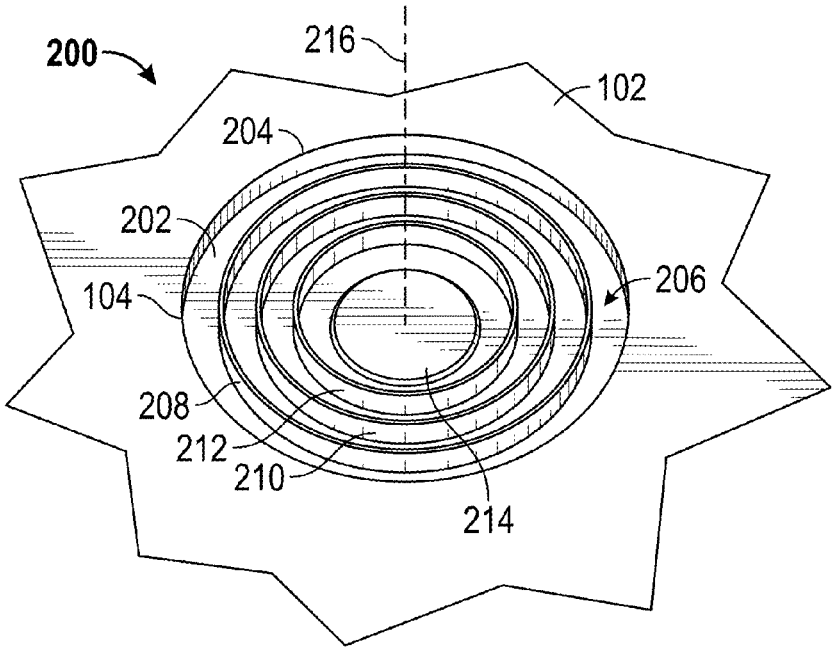
FIG. 2 is a perspective view of one embodiment of a device connector including a ring contact.

With reference now to FIG. 2, a perspective view of one embodiment of the device connector 104 is shown. As seen in FIG. 2, the device connector 104 is located within the powered device 102. The device connector 104 defines a cylindrical receptacle having a top 200 located in the plane of the outer surface of the powered device 102, a bottom 202 recessed below the plane of the powered device 102, and a side 204 extending between the top 200 and the bottom 202 of the device connector 104. As seen in FIG. 2, the device connector 104 defines a top 206, bottom 202, and side 204 of the volume.

The device connector 104 includes a ring connector 206. The ring connector 206 can include features that facilitate the physical, electrical, and/or communicating connection between the device connector 104 and the power connector 106. The ring connector 206 can be a variety of shapes and sizes, and can be located in a variety of positions within the device connector 104. In the embodiment shown in FIG. 2, the ring connector 206 is located on the bottom 202 of the device connector 104.

The ring connector 206 can include one or several electrical contacts 208, 210, 212, and in the embodiment depicted in FIG. 2, the ring connector 206 includes three electrical contacts 208, 210, 212. The electrical contacts 208, 210, 212 can link with mating contacts of the power connector 106 to thereby allow the passing of power and/or signals between the device connector 104 and the power connector 106. The electrical contacts 208, 210, 212 can be a variety of shapes and sizes and can be made from a variety materials. In some embodiments, the electrical contacts 208, 210, 212 can be made from a conductive material and/or partially conductive. In some embodiments, the electrical contacts 208, 210, 212 can include a metal, such as, for example, copper.

In some embodiments, the electrical contacts 208, 210, 212 can be circular in that the points of contact of the electrical contacts 208, 210, 212 with the bottom 202 of the device connector 104 form a circle. In some embodiments, the electrical contacts 208, 210, 212 can be made from a single piece of material, and in some embodiments, the electrical contacts 208, 210, 212 can be made from multiple pieces of material. In one embodiment, for example, the electrical contacts 208, 210, 212 can be made to allow the diameter of the electrical contacts 208, 210, 212 to change in response to the application of force to the electrical contacts 208, 210, 212. In some embodiments, for example, this can be accomplished by the use of an elastic material for the electrical contacts 208, 210, 212, and some embodiments, this can be accomplished via the design of the electrical contacts 208, 210, 212. In one embodiment, for example, the electrical contacts 208, 210, 212 can be made from several arcuate members arranged to form a circular electrical contacts 208, 210, 212. In some embodiments, these arcuate members can be linked so as to create a single electrical contacts 208, 210, 212 from several of mechanically separate members. In some embodiments, for example, the electrical contacts 208, 210, 212 can be made from a single piece of metal, but can have cutouts extending through a portion of the height of the electrical contacts 208, 210, 212 to allow the flexion of the least portions of the electrical contacts 208, 210, 212. Advantageously, the ability of the electrical contacts 208, 210, 212 to elastically change diameter can be used to facilitate the generation of retention forces that, in interaction with components of the power connector 106, can retain and/or facilitate in the retention of the connection between the device connector 104 and the power connector 106.

In some embodiments, each of the electrical contacts 208, 210, 212 can have a different diameter and a different perimeter. In such an embodiment, the electrical contacts 208, 210, 212 can be positioned within each other such that smaller electrical contacts are positioned within larger electrical contacts. As specifically seen in FIG. 2, the smallest electrical contact 212 is positioned within electrical contacts 208, 210, and the midsized electrical contact 210 is positioned within the largest electrical contact 208. In some embodiments, the electrical contacts 208, 210, 212 can be positioned around the same axis 216, in some embodiments, the electrical contacts 208, 210, 212 can be positioned around different axes. In one embodiment, the electrical contacts 208, 210, 212 are concentric.

The electrical contacts 208, 210, 212 can perform a variety of functions. In some embodiments, for example in which the device connector 104 transmits power to the powered device 102, the electrical contacts 208, 210, 212 can include a positive contact, a negative contact, and the ground. In some embodiments, for example in which the device connector 104 transmits communication signals to the powered device 102, the electrical contacts 208, 210, 212 can provide different signals and/or different signal components.

The ring connector 206 can further include a first locking feature 214. The first locking feature 214 can interact with the power connector 106 and/or with a component of the power connector 106 to secure the connection between the device connector 104 and the power connector 106 and/or to increase the separation of force to separate the device connector 104 from the power connector 106. The first locking feature 214 can be, for example, a mechanical lock and/or a magnet. In some embodiments, the first locking feature 214 can be located on some or all of the electrical contacts 208, 210, 212 and/or can be located on a portion or on all of the top 200, bottom 202, and/or side 204 of the device connector 104. In the embodiment depicted in FIG. 2, the first locking feature 214 is located on the bottom 202 of the device connector 104, and is specifically located within the electrical contacts 208, 210, 212. In the embodiment depicted in FIG. 2, the first locking feature 214 is a circular magnet concentrically located within the electrical contacts 208, 210, 212.

Figure 3:
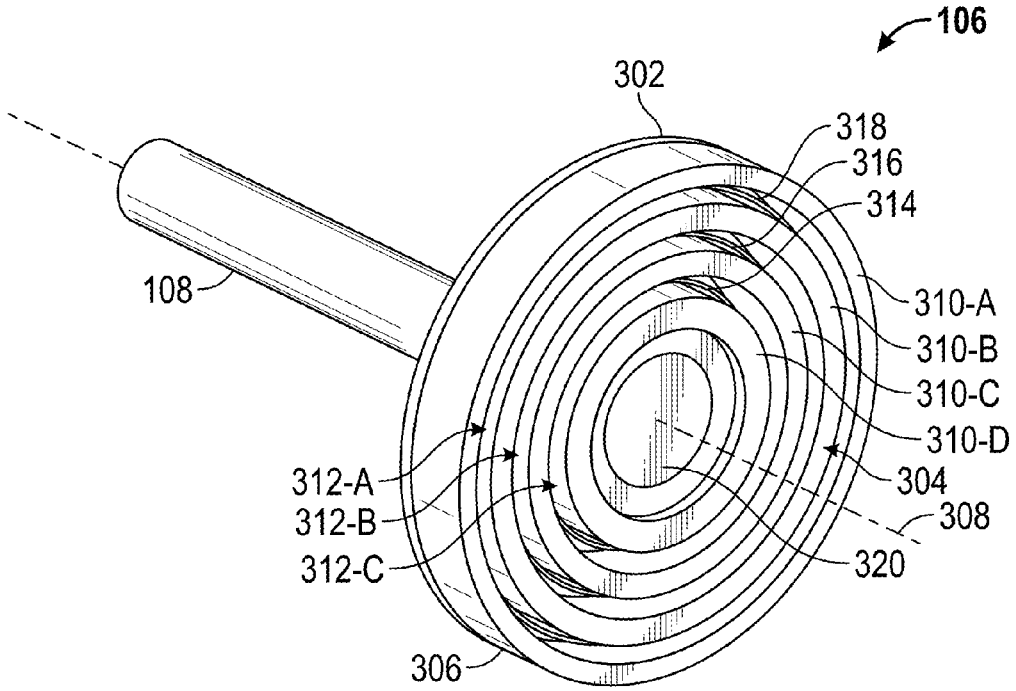
FIG. 3 is a perspective view of one embodiment of a power connector including a ring contact.

With reference now to FIG. 3, a perspective view of one embodiment of a power connector 106 connecting to a cord 108 is shown. The power connector 106 can connect with the device connector 104 and can be used to provide power and/or communication signals to the powered device 102. The power connector 106 can have a top 302, a bottom 304, a side 306, and an axis 308.

The power connector 106 can be a variety of shapes and sizes and can be made from a variety of materials. In the embodiment shown in FIG. 3, the power connector 106 is a cylindrical insert that can be received within the volume defined by the top 200, the bottom 202, and the side 204 of the device connector 104. In some embodiments, one or both of the device connector 104 and the power connector 106 can include features to facilitate the connection of the device connector 104 and the power connector 106. In one embodiment, for example, the sides 204, 306 of one or both of the device connector 104 and the power connector 106 can be shaped to facilitate the connection of the device connector 104 and the power connector 106. Specifically, in some embodiments, the sides 204, 306 of one or both of the device connector 104 and the power connector 106 can be tapered and/or angled so that the bottom 304 of the power connector 106 is smaller than the top 302 of the power connector 106 and smaller than the opening in the plane of the outer surface of the powered device 102 defined by the top 200 of the device connector 104. Advantageously, this taper and/or angle of the sides 204, 306 of one or both of the device connector 104 and the power connector 106 can ease the insertion of the power connector 106 into the device connector 104, and can thereby facilitate the connection of the power connector 106 and the device connector 104.

In the embodiment depicted in FIG. 3, the power connector 106 can include one or several insulator rings 310. The insulator rings 310 can protect electrical contacts 314, 316, 318 and can prevent shorting between the electrical contacts 314, 316, 308. The insulator rings 310 can be a variety of shapes and sizes and can be made from any desired material, and specifically from any desired insulative material. In some embodiments, the insulator rings 310 can have varying diameters, which diameters can allow the placement of the insulative rings 310 within each other. Thus, in the embodiment depicted in FIG. 3, a first insulative ring 310-A contains a second smaller insulative ring 310-B, which insulative ring 310-B contains a relatively smaller insulative ring 310-C, which insulative ring 310-C contains a relatively smaller insulative ring 310-D.

As further seen in FIG. 3, the insulative rings 310 can be sized and positioned so as to create a contact receptacle 312 between each pair of adjacent insulative rings 310. Specifically, adjacent insulative rings 310-A and 310-B create contact receptacle 312-A, adjacent insulative rings 310-B and 310-C create contact receptacle 312-B, and adjacent insulative rings 310-C and 310-D create contact receptacle 312-C. The contact receptacles 312 can be sized and shaped to receive electrical contacts 314, 316, 318 and to prevent unintentional connection and/or shorting between the electrical contacts 314, 316, 318.

The power connector 106 can include one or several electrical contacts 314, 316, 318, and in the embodiment depicted in FIG. 3, the power connector 106 includes three electrical contacts 314, 316, 318. The electrical contacts 314, 316, 318 can link with mating contacts of the device connector 104 to thereby allow the transmission of power and/or signals between the device connector 104 and the power connector 106. The electrical contacts 314, 316, 318 can be a variety of shapes and sizes and can be made from a variety materials. In some embodiments, the electrical contacts 314, 316, 318 can be made from a material that allows the conduction of power and/or signals. The electrical contacts 314, 316, 318 can be electrically conductive, can be made from electrically conductive material, and/or can be partially conductive. In some embodiments, the electrical contacts 314, 316, 318 can be metal, such as, for example, copper, and in some embodiments, the electrical contacts 314, 316, 318 can be electrically connected with the cord 108.

The electrical contacts 314, 316, 318 can be circular in that points of contact of the electrical contacts 314, 316, 318 with the power connector 106 form a circle. In some embodiments, the electrical contacts 314, 316, 318 can be made from a single piece of material, and in some embodiments, the electrical contacts 314, 316, 318 can be made from multiple pieces of material. In one embodiment, for example, the electrical contacts 314, 316, 318 can allow the diameter of the electrical contacts 314, 316, 318 to change in response to the application of force to the electrical contacts 314, 316, 318. In some embodiments, for example, this can be accomplished by the use of an elastic material for the electrical contacts 314, 316, 318, and some embodiments, this can be accomplished via the design of the electrical contact 314, 316, 318. In one embodiment, for example, electrical contacts 314, 316, 318 can be made from several arcuate members arranged to form a circular electrical contact 314, 316, 318. In some embodiments, these arcuate members can be electrically linked so as to create a single electrical contact 314, 316, 318 from a number of mechanically separate members. In some embodiments, for example, the electrical contacts 314, 316, 318 can be made from a single piece of metal, but can have cutouts extending through a portion of the height of the electrical contacts 314, 316, 318 to allow the flexion of at least portions of the electrical contacts 314, 316, 318. Advantageously, the ability of the electrical contacts 314, 316, 318 to elastically change diameter can facilitate the generation of retention forces that, in interaction with components of the device connector 104, can retain and/or facilitate in the retention of the connection between the device connector 104 and the power connector 106.

In some embodiments, each of the electrical contacts 314, 316, 318 can have a different diameter and a different perimeter. In such an embodiment, the electrical contacts 314, 316, 318 can be positioned within each other such that smaller electrical contacts are positioned within larger electrical contacts. As specifically seen in FIG. 3, the smallest electrical contact 318 is positioned within electrical contacts 314, 316, and the midsized electrical contact 316 is positioned within the largest electrical contact 314. In some embodiments, the electrical contacts 314, 316, 318 can be positioned around the same axis 308, in some embodiments, the electrical contacts 314, 316, 318 can be concentric, and in some embodiments, the electrical contacts 314, 316, 318 can be positioned around different axes.

The electrical contacts 314, 316, 318 can perform a variety of desired functions. In some embodiments, for example in which the power connector 106 transmits power to the powered device 102, the electrical contacts 314, 316, 318 can include a positive contact, a negative contact, and the ground. In some embodiments, in which the power connector 106 transmits communication signals to the powered device 102, the electrical contacts 314, 316, 318 can provide different signals and/or different signal components.

The power connector 106 can include a second locking feature 320. The second locking feature 320 can interact with the device connector 104 and/or with the first locking feature 214 of the device connector 104 to secure the connection between the device connector 104 and the power connector 106 and/or to increase the force required to separate the device connector 104 from the power connector 106, which force is also referred to herein as the separation force. The second locking feature 320 can be, for example, a mechanical lock and/or a magnet. The second locking feature 320 can be located on some or all of the electrical contacts 314, 316, 318 and/or can be located on a portion or all of the top 302, bottom 304, and/or side 306 of the power connector 106. In the embodiment depicted in FIG. 3, the second locking feature 320 is located on the bottom 302 of the power connector 106, and is specifically located within the electrical contacts 314, 316, 318. In the specific embodiment depicted in FIG. 3, the second locking feature 320 is a circular magnet concentrically located within the electrical contacts 314, 316, 318.

Figure 4:
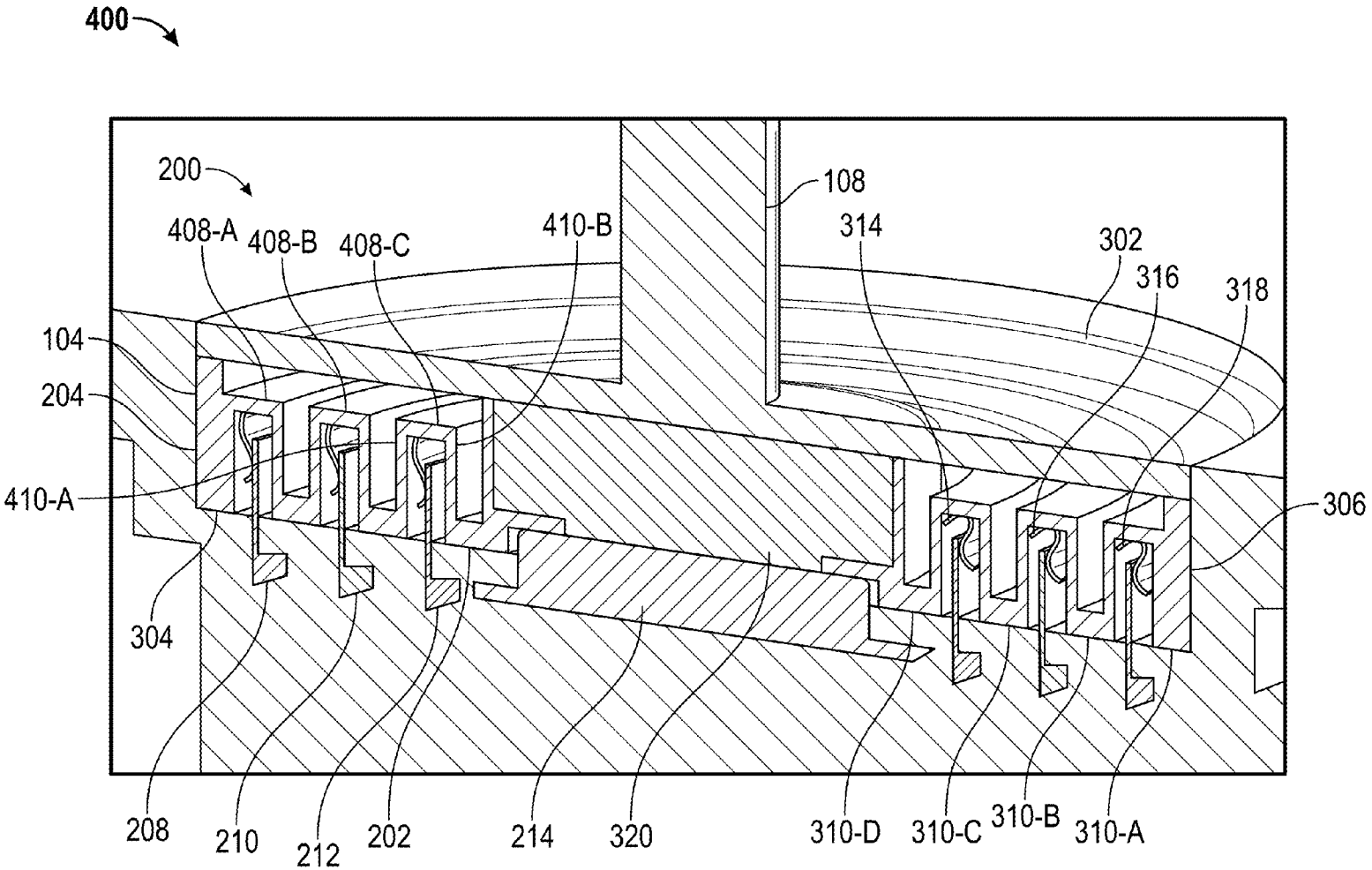
FIG. 4 is a section view of one embodiment of a power connector having a ring contact inserted into a device connector having a ring contacts.

With reference now to FIG. 4, a section view of one embodiment of a power connector 106 inserted into a device connector 104 is shown. As seen in FIG. 4, the contact receptacles 312 of the power connector 106 include a bottom 408, an exterior side 410-A, and an interior side 410-B. The combination of the bottom 408, the exterior side 410-A, and the interior side 410-B define an internal volume of the contact receptacles 312, which internal volume contains the electrical contacts 314, 316, 318. In some embodiments, the electrical contacts 314, 316, 318 are connected to one or several of the bottom 408, the exterior side 410-A, and the interior side 410-B of the contact receptacle 312 in which the electrical contact 314, 316, 318 is located. In some embodiments, the electrical contact 314, 316, 318 can be mechanically or integrally connected to the portion of the contact receptacle 312, and in some embodiments, the electrical contact 314, 316, 318 can be adhered to the portion of the contact receptacle 312. In one embodiment, for example, the electrical contacts 314, 316, 318 can be connected to the portion the contact receptacle 312 in which they are contained by, for example, one or several screws.

As further seen in FIG. 4, in some embodiments, the relatively furthest radially positioned of the electrical contacts 208, 318 can be positive, the middle of the electrical contacts 210, 316 can be a ground, and the innermost of the electrical contacts 212, 314 can be negative.

As further seen in FIG. 4, the power connector 106 can be inserted into the volume defined by the top 200, bottom 202, and side 204 of the device connector 104. This insertion of the power connector 106 into the device connector 104 can bring the electrical contacts 208, 210, 212 of the device connector 104 into contact with the electrical contacts 314, 316, 318 of the power connector 106, as well as the first locking feature 214 of the device connector 104 into contact with the second locking feature 320 of the power connector 106. This contact between the electrical contacts 208, 210, 212 of the device connector 104 with the electrical contacts 314, 316, 318 of the power connector 106 allows the transmission of power and/or signals from the cord 108 to the powered device 102, and this contact between the first locking feature 214 of the device connector 104 and the second locking feature 320 of the power connector 106 secures the connection between device connector 104 and the power connector 106.

Figure 5:
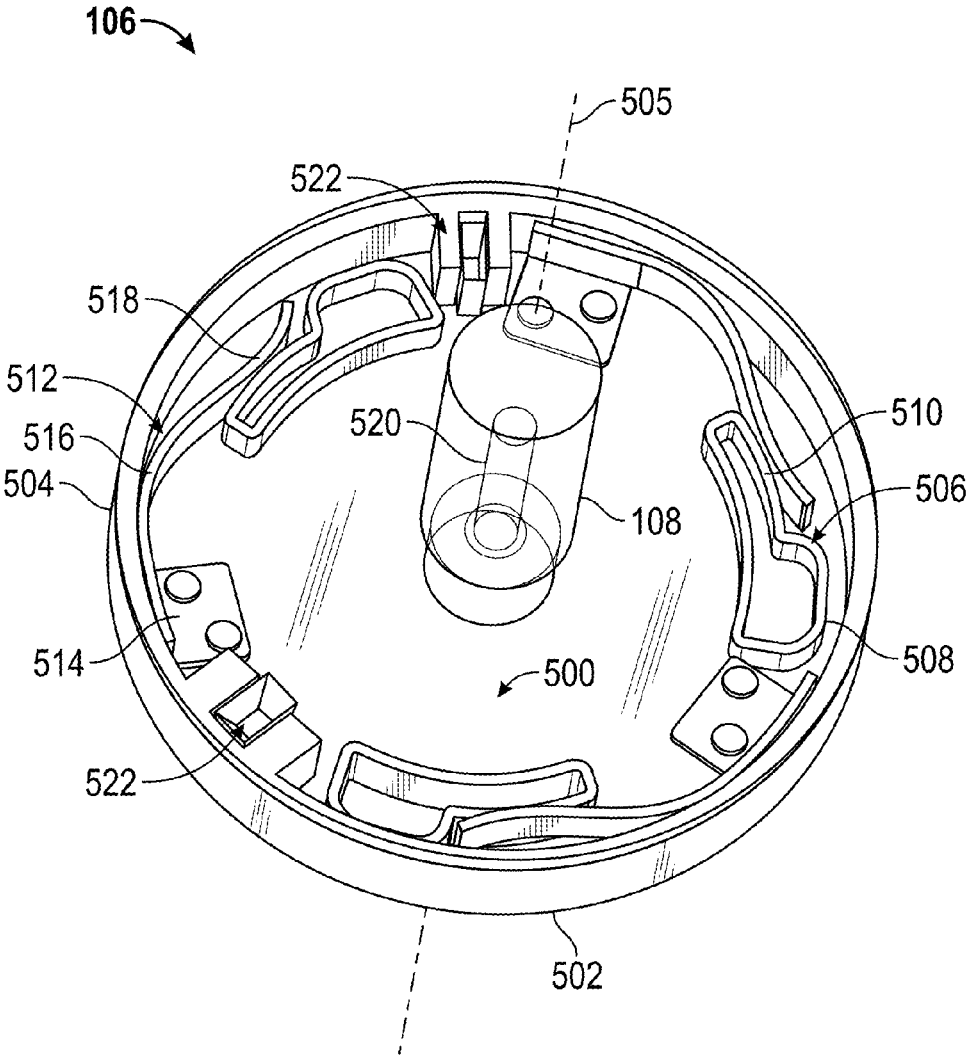
FIG. 5 is a perspective view of one embodiment of a power connector including twist lock receptacles.

With reference now to FIG. 5, a perspective view of one embodiment of a power connector 106 with twist lock receptacles is shown. The power connector 106 shown in FIG. 5 includes a top 500, a bottom 502, a side 504, and a central axis 505. The power connector 106, as also discussed above, can be a variety of shapes and sizes and can be made from a variety materials. In the embodiment shown in FIG. 5, the power connector 106 is cylindrical and can be, for example, made from plastic. In the embodiment shown in FIG. 5, the top 500, bottom 502, and side 504 define an internal volume of the power connector 106, which internal volume contains components of the power connector 106.

The power connector 106 can include a twist lock receptacle 506. In the embodiment of the power connector 106 depicted in FIG. 5, the power connector 106 includes three twist lock receptacles 506. The twist lock receptacle 506 can, when the power connector 106 is in a first angular position, receive an electrical contact of the device connector 104, and can, when the power connector 106 is in a second angular position, retain the electrical contact from the device connector 104. The twist lock receptacle 506 can be a variety of shapes and sizes and can be located in a variety of positions on the power connector 106. In the embodiment shown in FIG. 5, the twist lock receptacle 506 is located on the bottom 502 of the power connector 106. In some embodiments, the twist lock receptacle 506 can be located, sized, and shaped so as to allow access to the internal volume of the power connector 106.

The twist lock receptacle 506 can include a receiving portion 508 and a contact portion 510. The receiving portion 508 can be sized and shaped to allow a contact from the device connector 104 to move through the twist lock receptacle 506 and into or out of the internal volume of the power connector 106. The contact portion 510 of the twist lock receptacle 506 can be sized and shaped to retain the contact from the device connector 104 that was received via the receiving portion 508 of the twist lock receptacle 506. In some embodiments, the receiving portion 508 and the contact portion 510 of the twist lock receptacle 506 are arranged so as to allow movement of the contact from the device connector 104 from the receiving portion 508 to the contact portion 510 which the angular position of the power connector 106 is changed (i.e. by twisting) from a first position to a second position, and to allow movement of a contact of the device connector 104 from the contact portion 510 to the receiving portion 508 when the angular position of the power connector 106 is changed (i.e. by twisting) of the power connector 106 within the device connector 104, from a second position to a first position.

The power connector 106 can include a contact 512, and as specifically depicted in the embodiment of FIG. 5, the power connector 106 includes three contacts 512. The contact 512 can be electrically connected with the cord 108. The contact 512 can connect with the contact of the device connector 104, and can conduct power and/or signals to and from the contact of the device connector 104. The contact 512 can be made from a variety of materials and can have a variety of shapes and sizes. In some embodiments, the contact 512 can be partially and/or completely conductive.

The contact 512 can include an affixation portion 514. The affixation portion 514 can affix the contact 512 to the power connector 106, and as specifically depicted in FIG. 5, can affix the contact 512 to the bottom 502 of the power connector 106. The affixation portion 514 can be a planar member that can be, for example, receive one or several affixation features. In some embodiments, these features can include one or several of an adhesive, the mechanical fastener, and/or an extruded connector. In the embodiment depicted in FIG. 5, the affixation portion 514 is connected to the bottom 502 of the power connector 106 via to connection features.

The contact 512 can include a deflection portion 516. In some embodiments, the deflection portion 516 can include geometry to allow the elastic deformation of the contact 512 when the contact of the device connector 104 is received within the contact portion 510 of the twist lock receptacle 506. In some embodiments, the deflection portion 516 can be designed so as to maintain constant contact between portions of the contact 512 and the contact of the device connector 104 when the contact of the device connector 104 is received within the contact portion 510 of the twist lock receptacle 506.

The contact 512 can include a contact portion 518. The contact portion 518 can engage with the contact of the device connector 104. The contact portion 518 can be electrically conductive and can be made from a low friction material, which low friction material can facilitate the movement of the power connector 106 between the first and second positions.

The power connector 106 can include one or several positioning and/or locking features 520. In some embodiments, the positioning and/or locking features 520 can facilitate the positioning of the power connector 106 within the device connector 104, and in some embodiments, the positioning and/or locking features 520 can selectively secure the power connector 106 within the device connector 104. Specifically, in some embodiments, the positioning and/or locking features 520 can prevent the movement of the power connector 106 from the first position to the second position, and specifically can prevent the angular movement of the power connector 106 from the first position to the second position.

The power connector 106 can include one or several clocking features 522. In some embodiments, the clocking features 522 can, in connection with features of the device connector 104, prevent the connection of the contacts 512 of the power connector 106 with the contacts of the device connector 104 when the power connector 106 is not in the desired orientation with respect to the device connector 104. In some embodiments, the clocking features 522 can be integral in other components of the power connector 106. In one embodiment, for example, the clocking features 522 can be incorporated in the different radial and/or angular positioning of the twist lock receptacles 506 of the power connector 106 and corresponding radial and/or angular positioning of the twist-lock contacts 606 of the device connector 104. In some embodiments, the clocking features 522 can be features located on the top 500, the bottom 502, and/or the side 504 of the power connector 106. The clocking features 522 can be any desired shape and size and can be located on any desired portion of the power connector 106 that interacts with a portion of the device connector 104

Figure 6:
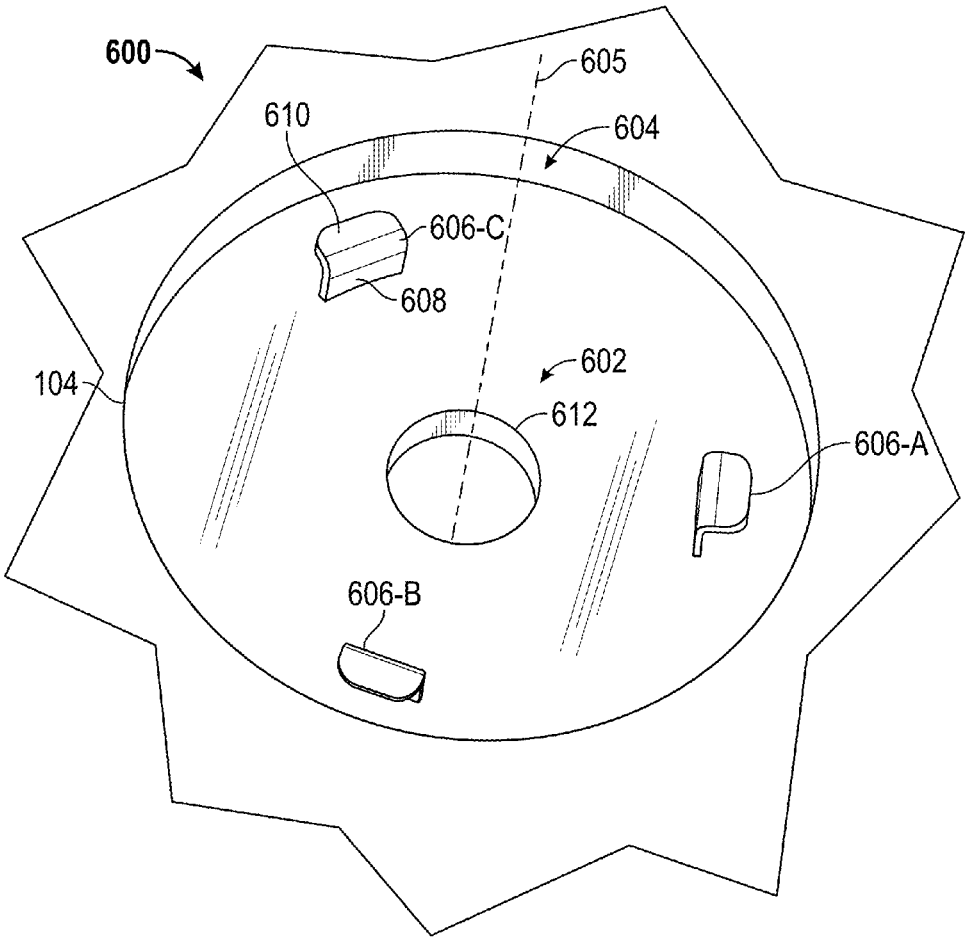
FIG. 6 is a perspective view of one embodiment of a device connector including twist lock contacts.

With reference now to FIG. 6, a perspective view of one embodiment of the device connector 104 is shown. The device connector 104 can include a top 600, a bottom 602, a side 604, and an axis 605. The top 600, bottom 602, and side 604 of the device connector can define an internal volume that can be sized and shaped to receive the power connector 106. The size and shape of the internal volume of the device connector 104 can be any desired size and/or shape.

The device connector 104 depicted in FIG. 6 includes a twist lock contact 606, and specifically includes three twist lock contacts 606-A, 606-B, 606-C. the twist lock contacts 606 can connect with the contacts 512 of the power connector 106 to thereby place the powered device 102 in electric connection with the cord 108. The twist lock contacts 606 can be any desired size or shape and can be made from any desired material. In some embodiments, the twist lock contacts 606 can be conductive and/or partially conductive and/or can include a conductive material. The twist lock contact 606 can be located on any desired portion of the device connector 104 and, in the embodiment depicted in FIG. 6, are located on the bottom 602 of the device connector 104. The twist lock contacts 606 can be equally angularly spaced and/or can be unequally angularly spaced. Similarly, the twist lock contact 606 can have the same and/or a different radial and/or angular placement with respect to the axis 605 of the device connector 104. In some embodiments, the radial and/or angular placement of the twist lock contacts 606 of the device connector 104 corresponds to the angular and/or radial placement of the twist lock receptacles 506 of the power connector 106.

The twist lock contacts 606 can include an insertion portion 608 and a contact portion 610. In some embodiments, the insertion portion 608 can be sized and shaped to extend from the portion of the device connector 104, through the twist lock receptacle 506 of the power connector 106, and into the internal volume of the power connector 106. In the embodiment depicted in FIG. 6, the insertion portion 608 of the twist lock contacts 606 are planar members that extend from the bottom 602 of the device connector 104, and specifically extend approximately perpendicular from the bottom 602 of the device connector 104.

The contact portion 610 of the twist lock contacts 606 can be sized and shaped to engage with the contacts 512 of the power connector 106 when the power connector 106 is moved to and/or is in the second position. In some embodiments, the contact portion 610 of the twist lock contacts 606 can be conductive. In the embodiment depicted in FIG. 6, the contact portion 610 of the twist lock contacts 606 extends from the distal (with respect to the bottom 602 of the device connector 104) portion of the insertion portion 608 of the twist lock contact 606. As specifically depicted in FIG. 6, the contact portion 610 of the twist lock contact 606 extends approximately perpendicular to the direction of extension of the insertion portion 608 of the twist lock contacts 606.

The device connector 104 can further include a positioning and/or locking feature 612. In some embodiments, the positioning and/or locking feature 612 of the device connector 104 can interact with the positioning and/or locking feature 520 of the power connector to facilitate the connection of the device connector 104 and the power connector 106 and/or to secure the connection of the device connector 104 and the power connector 106. In some embodiments, the device connector 104 can further include one or several clocking features (not shown) that can facilitate the proper orientation of the power connector 106 with respect to the device connector 104. These features can include aspects discussed above with respect to the clocking features 522 of the power connector 106.

Figure 7:
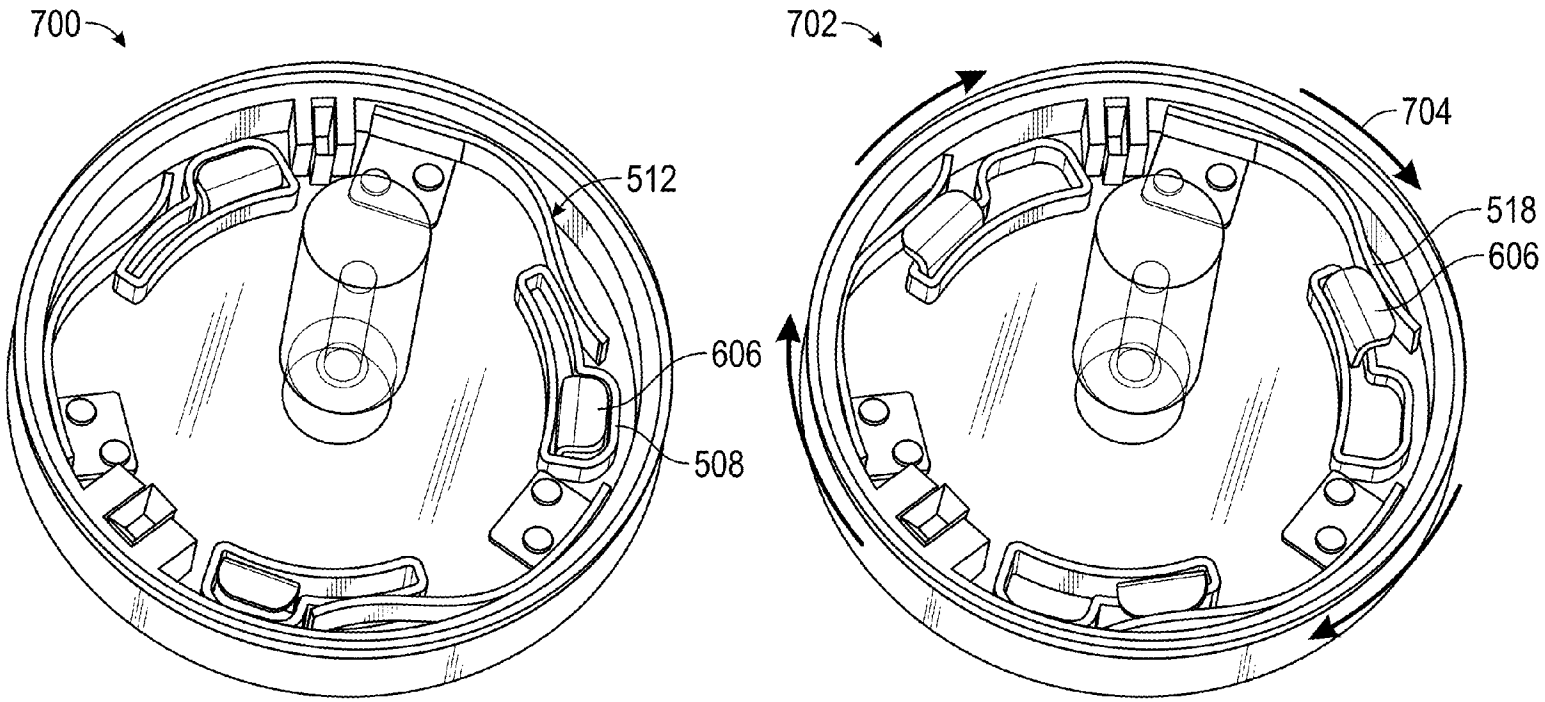
FIG. 7 is a perspective view of one embodiment of a method of connecting power connector including twist lock receptacles with a device connector including twist lock contacts.

With reference now to FIG. 7, a perspective view of one embodiment of a power connector 106 within device connector 104 in the first position and in the second position are shown. As shown in FIG. 7, when the power connector 106 is in the first position 700, the twist lock contacts 606 are inserted into the receiving portion 508 of the twist lock receptacles 506. As specifically seen in FIG. 7, the insert portion 608 of the twist lock contacts 606 extends through the twist lock receptacle 506 and into the internal volume of the power connector 106, and the twist lock contacts 606 do not abut the contact 512 of the power connector 106. As further seen in FIG. 7, when the power connector 106 is in the second position 702, the twist lock contacts are in the contact portion 510 of the twist lock receptacles 506 and are in contact with the contact portion 518 of the contacts 512 of the power connector 106. Further, the insert portion 608 of the twist lock contacts 606 extends through the contact portion 510 of the twist lock receptacle 506 and the contact portion 610 of the twist lock contacts 606 are contained within the internal volume of the power connector 106. The power connector 106 can be moved from the first position 700 to the second position 702 by twisting the power connector 106 in the direction indicated by the arrow 704.

Figure 8:
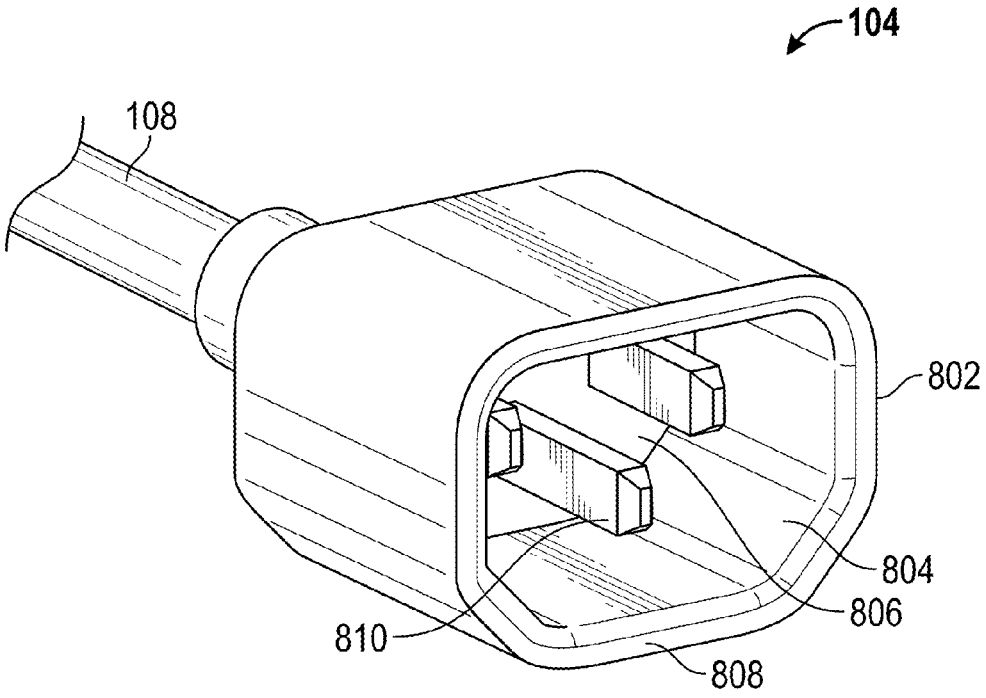
FIG. 8 is a perspective view of one embodiment of a remote receptacle.

With reference now to FIG. 8, a perspective view of one embodiment of the device connector 104 having a remote receptacle 802 is shown. The remote receptacle 802 can be a variety of shapes and sizes and can be made from a variety of materials. In some embodiments, the remote receptacle 802 can be made from a nonconductive material such as, for example, a plastic, polymer, resin, composite, and/or rubber, and can be sized and shaped to allow meeting with a corresponding power connector 106. In contrast to other embodiments of the device connector 104 previously discussed herein, the embodiment of the device connector 104 shown in FIG. 8 includes a cord 108, which cord 108 extends to the powered device 102, and which cord 108 is unattachable, or hardwired, to the powered device 102.

As seen in FIG. 8, the remote receptacle 802 includes an interior side 804, a bottom 806, and a top 808. The combination of the interior side 804, the bottom 806, and the top 808 defines an interior volume of the remote receptacle 802. This interior volume of the remote receptacle 802 can have a variety of shapes and sizes which shapes and sizes can correspond to the mating power connector 106.

The interior volume of the remote receptacle 802 can include one or several contacts 810. In the embodiment depicted in FIG. 8, the remote receptacle 802 includes three contacts 810, which contacts 810 are a positive contact, a negative contact, and a ground. The contacts 810 can be electrically connected with the cord 108, and can electrically connect with contacts of the power connector 106. The contacts 800 can be made from a variety of materials and can have a variety of shapes and sizes. In some embodiments, the contacts 800 can be partially and/or completely conductive.

Figure 9:
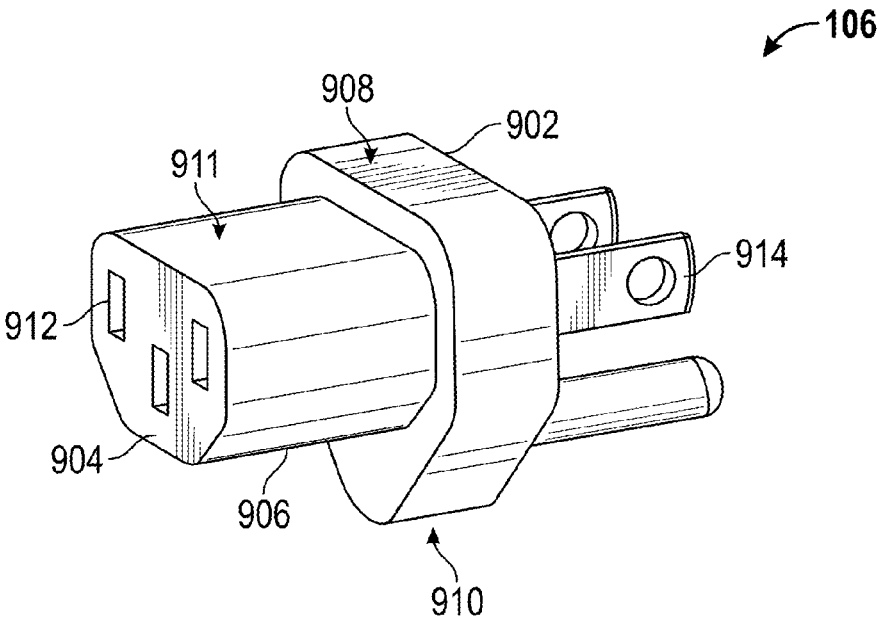
FIG. 9 is a perspective view of one embodiment of an insert for a power connector with an insert.

With reference now to FIG. 9, a perspective view of one embodiment of a power connector 106 is shown. The power connector 106 shown in FIG. 9 is sized and shaped to matingly connect with the device connector 104 shown in FIG. 8. The power connector 106 includes a front 902, a back 904, an insert side 906, a top 908, and a bottom 910.

In some embodiments, the power connector 106 can include an insert 911 that is defined in part by the back 904 and the insert side 906 of the power connector 106. The insert 911 can be any desired size or shape and can be made from any desired material. In some embodiments, the insert 911 is sized and shaped to fit into and be received by the remote receptacle 802 of the device connector 104, and in some embodiments, the insert 911 is made of a nonconductive material. In some embodiments, the length of the insert 911, as measured along the insert side 906 can allow the insert 911 to be completely inserted into the remote receptacle 802. In some embodiments, the full insertion of the insert 911 into the remote receptacle 802 can cause the back 904 of the insert 911 to contact the bottom 806 of the remote receptacle 802.

The insert 911 can include one or several contact receptacles 912. In the embodiment depicted in FIG. 9, the insert 911 can include three contact receptacles 912. The contact receptacles 912 can be sized and shaped so as to receive one or several of the contacts 810 of the remote receptacle 802. In some embodiments, the contact receptacles 912 can be sized and shaped so as to each receive one of the contacts 810 of the device connector 104.

The contact receptacles 912 can include a contact (not shown). The contact can be electrically connected with electrical contact 914 which can be, for example, located on the front 902 of the power connector 106. The electrical contact 914 can have a variety of shapes and sizes, and can be made from a variety of materials which can be, for example, conductive materials. In some embodiments, the electrical contact 914 can be a plurality of electrical contacts that are sized, shaped, and arranged to interface with an outlet. The electrical contacts can be sized, shaped, and arranged, in one embodiment, to interface with any desired electrical outlet, and can create, for example, a NEMA connector, or the like.

In some embodiments, the contact can be sized, shaped, and located within the contact receptacle 912 so as to engage with, and electrically connect with the contact 810 of the remote receptacle 802 received within the contact receptacle 912. In some embodiments, the contact can be conductive and/or made of a conductive or partially conductive material. In some embodiments, the contacts within the contact receptacles 912 can be connected with the electrical contacts 914 such that when the power connector 106 is received within the remote receptacle 802 of the device connector 104, the polarity of the electrical contacts 810 of the remote receptacle 802 matches the polarity of the electrical contacts 914. Advantageously, the size, shape, and location of the contact receptacles 912 can be different than the size, shape, and arrangement of the electrical contact 914 or the electrical contacts. In some embodiments, the size, shape, and location of the contact receptacles 912 can remain the same across multiple power connectors 106 that have electrical contacts corresponding to different connector standards. Thus, in such an embodiment, one of the power connectors 106 may have electrical contacts sized, shaped, and arranged to be a NEMA connector, and others of the power connectors 106 may have electrical contacts sized, shaped, and arranged to be a Europlug, a German "Schuko" plug, a Swiss plug, or the like. Due to the constant size, shape, and position of the contact receptacles 912 of the power connectors 102, power connectors 106 that function with different outlets and/or comply with different standards can be used with the same remote receptacle 802.

Figure 10:
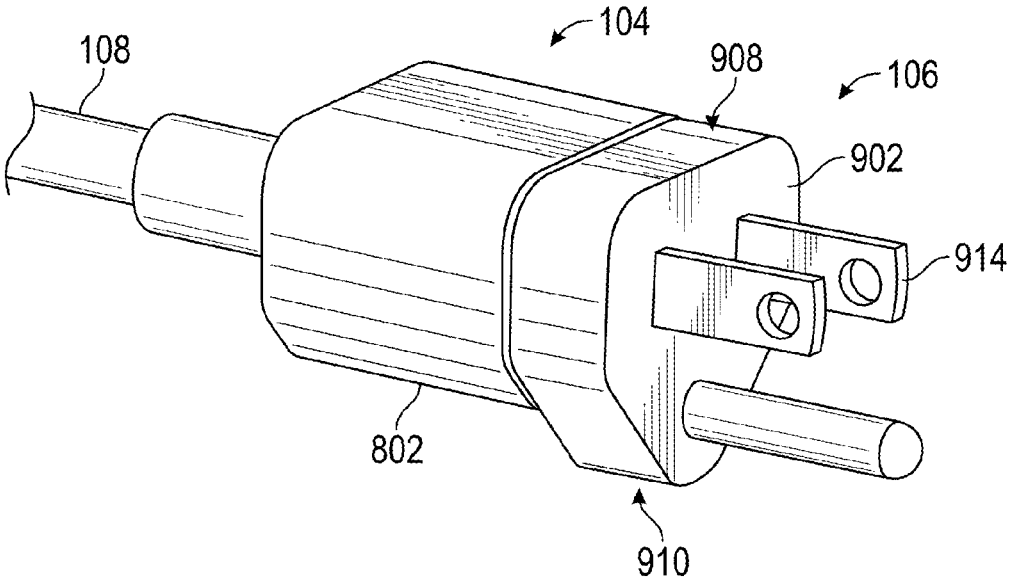
FIG. 10 is a perspective view of one embodiment of the insert of a power connector received within a remote receptacle.

With reference now to FIG. 10, a perspective view of one embodiment of the power connector 106 meeting connected with device connector 104 is shown. As seen in FIG. 10, the insert 911 of the power connector 106 is enclosed within the remote receptacle 802, and thereby connecting the contacts 810 of the remote receptacle 802 with the contacts contained within the contact receptacles 912 of the insert 911, and the electrical contacts 914 of the power connector. Advantageously, as the mating of the power connector 106 the device connector 104 is not dependent on the electrical contacts 914 of the power connector 106, the device connector 104 can connect with power connectors 106 having different electrical contact 914 configurations such as, for example, electrical contact configurations compliant with electrical standards of different countries or regions.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A powered device, comprising:

a device housing enclosing electrical components and defining an opening leading into a receptacle connector that includes a base portion recessed below an outer surface of the device housing;

a first electrical contact having a substantially circular geometry and extending away from the base portion of the receptacle connector; and a second electrical contact extending from the base portion of the receptacle connector and enclosing the first electrical contact, wherein the first and second electrical contacts are configured to receive electricity for powering the electrical components.

2. The powered device of claim 1, wherein the first and second electrical contacts are concentric.

3. The powered device of claim 1, further comprising a third electrical contact defining a circle and extending from the base portion of the receptacle connector, wherein the circle of the third electrical contact encloses the first and the second electrical contacts.

4. The powered device of claim 3, wherein the electrical contacts comprise a ground electrically coupled to a ground terminal within the device housing.

5. The powered device of claim 4, wherein the second electrical contact comprises the ground.

6. The powered device of claim 1, further comprising a locking feature.

7. The powered device of claim 6, wherein the locking feature comprises a magnet.

8. The powered device of claim 7, wherein the magnet is encircled by the first and second electrical contacts.

9. The powered device of claim 6, wherein the locking feature is located on one or all of the electrical contacts.

10. A power connector, comprising:

an insert having a first end and a second end opposite the first end, the first end of the insert being configured to be received within a receptacle of a mating connector and defining concentric channels extending from the first end of the insert towards the second end of the insert;

a first electrical contact defining a first closed shape and being positioned within a first channel of the concentric channels; and a second electrical contact defining a second closed shape and being positioned within a second channel of the concentric channels; and a third electrical contact defining a third closed shape and being positioned within a third channel of the concentric channels, the third electrical contact being electrically coupled with a ground terminal.

11. The power connector of claim 10, wherein the first and second closed shapes comprise concentric circles.

12. The power connector of claim 11, wherein the first electrical contact is positioned entirely within the first channel.

13. The power connector of claim 10, wherein the third electrical contact has a substantially circular geometry and is positioned between the first and the second electrical contacts.

14. The power connector of claim 10, wherein the first and second electrical contacts have substantially circular geometries.

15. The power connector of claim 10 further comprising a locking feature.

16. The power connector of claim 15, wherein the locking feature comprises a magnet.

17. The power connector of claim 16, wherein the magnet is encircled by the first and second electrical contacts.

18. The power connector of claim 10, wherein the electrical contacts comprise a positive contact, a negative contact, and a ground.

* * * * *